US007093691B1

(12) United States Patent
Vaughan et al.

(10) Patent No.: US 7,093,691 B1
(45) Date of Patent: Aug. 22, 2006

(54) PORTABLE SCISSOR-LIFT-ASSEMBLY

(76) Inventors: Barry Vaughan, 4161 Luneman Rd., Placerville, CA (US) 95667; Alvin Vaughan, 1371 Martin La., Placerville, CA (US) 95667

( * ) Notice: Subject to any disclaimer, the term of this patent is extended or adjusted under 35 U.S.C. 154(b) by 0 days.

(21) Appl. No.: 11/096,526

(22) Filed: Apr. 4, 2005

(51) Int. Cl.
*B66B 9/02* (2006.01)

(52) U.S. Cl. ..... 187/269; 187/211; 187/244; 187/271; 187/406; 182/69.5; 182/69.6; 182/131; 414/444; 108/106; 108/109; 108/149; 108/151; 108/179; 280/47.34; 280/47.35

(58) Field of Classification Search ..... 182/69.5, 182/69.6, 131, 186.6; 248/276.1, 277; 414/444; 187/211, 244, 269, 271, 406; 108/57, 106, 108/109, 179, 147, 149, 151; 280/47.34, 280/47.35

See application file for complete search history.

(56) References Cited

U.S. PATENT DOCUMENTS

| | | | | | |
|---|---|---|---|---|---|
| 1,555,103 | A * | 9/1925 | Christian | 182/14 |
| 2,483,894 | A * | 10/1949 | Feibel | 187/269 |
| 2,604,334 | A * | 7/1952 | Schultz | 280/47.35 |
| 2,802,575 | A * | 8/1957 | Jeune et al. | 108/106 |
| 4,391,345 | A | 7/1983 | Paul | |
| 4,405,116 | A * | 9/1983 | Eisenberg | 254/122 |
| 4,930,598 | A | 6/1990 | Murrill et al. | |
| D403,783 | S | 1/1999 | Takai | |
| 6,035,973 | A * | 3/2000 | Neal et al. | 187/244 |
| 6,044,927 | A | 4/2000 | Newlin | |
| 6,530,740 | B1 * | 3/2003 | Kim | 414/490 |
| 6,571,913 | B1 | 6/2003 | Puszkiewicz | |
| 6,651,775 | B1 | 11/2003 | Bassett, Jr. | |
| 2001/0040233 | A1 * | 11/2001 | Chamberlain | 254/4 R |

* cited by examiner

*Primary Examiner*—Kathy Matecki
*Assistant Examiner*—Stefan Kruer

(57) ABSTRACT

A lift assembly includes a first platform provided with a top surface, a pair of opposed sides, and wheels and brackets connected to one of the sides for rotating the assembly. A plurality of rectilinear support shafts have opposed end portions conjoined to the platform and extending upwardly therefrom, and are spaced at opposed corners of the platform. Inverted U-shape guide rails are telescopically engageable along a length of the support shafts and have a pair of rectilinear regions slidably positionable about the support shafts. A second platform is provided with top and bottom surfaces, and apertures formed at opposed corners thereof that are vertically registered with the support shafts. A lifting mechanism is included for vertically biasing the second platform and the guide rails along the support shafts. The lifting mechanism is connected to the top surface of the first platform and the bottom surface of the second platform.

12 Claims, 5 Drawing Sheets

PORTABLE SCISSOR-LIFT-ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lift assemblies and, more particularly, to a scissor-lift assembly for lifting an operator along a vertical plane.

2. Prior Art

Homeowners and small commercial contractors struggle with small interior and exterior projects that are at elevated heights, barely out of arms reach. They primarily rely on stepladders, stools, and extension ladders for these projects. Unfortunately, the user must constantly travel up and down these structures to retrieve tools and materials, which is time and energy consuming. Furthermore, the work area is limited to the reach of the user. Such stepladders, stools, etc. place the user in an unsafe situation that may result in their falling from an elevated height. For example, as the user leans to extend his reach, the ladder or stool may become unstable and tilt or the user may loose his grip or balance and fall to the ground. Also, the user needs to constantly reposition the structure as the work progress. This is very inefficient and wastes precious time and energy. Stability of the structure is also an issue when working on unleveled surfaces, especially when working outdoors.

Conventional aerial lifts are primarily designed for commercial and industrial users. Such a lift's initial purchase cost is high with significant reoccurring maintenance costs. The lifts employ hydraulics to elevate working platforms. The hydraulics require significant maintenance and constantly leak, making these machines unsuited for internal use for home or light industrial or small commercial operations. The relative size of the available machines also limits their use to external areas or internal spaces with wide doorways and high ceiling not commonly found in homes. Their use within a home or office is prohibited due to maneuverability through passageways and the leaking hydraulic fluid. Most conventional aerial lifts are powered by diesel engines, propane motors or large battery packs, that also limits their usage within structures due to environmental issues.

Accordingly, a need remains for a scissor-lift assembly in order to overcome the above-noted shortcomings. The present invention satisfies such a need by providing a lift assembly that is easily operated, convenient to use, relatively light weight in design, increases user safety, and saves time and money. Homeowners and small commercial business owners, such as painters, find the scissor-lift assembly quite helpful. The lift assembly eliminates the danger of falling off of an unstable structure while also increasing the available work area, resulting in fewer trips to locate tools and materials for the job.

BRIEF SUMMARY OF THE INVENTION

In view of the foregoing background, it is therefore an object of the present invention to provide a scissor-lift assembly. These and other objects, features, and advantages of the invention are provided by a portable assembly for lifting an operator along a vertical plane.

The assembly includes a first platform provided with a planar top surface that has a centrally registered longitudinal axis. Such a first platform further has a pair of opposed sides equidistantly spaced from the longitudinal axis and traveling parallel thereto. The first platform includes a plurality of wheels and a plurality of brackets operably connected thereto wherein the wheels and the brackets extend outwardly from one of the sides and has an axis of rotation situated orthogonal thereto. Such wheels and brackets are spaced at opposed end portions of the platform. The assembly can be rotated about one side in such a manner that the wheels become operably engaged with a ground surface while the first and second platforms become oriented perpendicular to the ground surface and thereby advantageously allow the operator to quickly and readily transport the assembly between remote locations.

A plurality of rectilinear support shafts have opposed end portions securely conjoined to the platform and extending upwardly therefrom along a vertical axis situated orthogonal to the longitudinal axis. Such rectilinear support shafts are equidistantly spaced at opposed corners of the platform and are coextensive.

A pair of inverted U-shape guide rails are telescopically engageable along a longitudinal length of the support shafts. Each guide rail has a pair of monolithically formed rectilinear regions slidably positionable about the support shafts such that the guide rails can effectively be raised and lowered along a predetermined vertical path during operating conditions.

A second platform is provided with planar top and bottom surfaces and has a plurality of apertures formed at opposed corners thereof. Such apertures are vertically registered with the support shafts and effectively receive the support shafts therethrough such that the second platform can conveniently be raised and lowered in sync with the guide rails. The first and second platforms are coextensive.

A lifting mechanism is included for vertically biasing the second platform and the guide rails along a longitudinal length of the support shaft. Such a lifting mechanism is securely connected to the top surface of the first platform and the bottom surface of the second platform.

The lifting mechanism preferably includes a motor securely conjoined to the top surface of the first platform, a primary power source situated adjacent to the motor and electrically mated thereto, and a secondary power source situated adjacent to the motor. Such a secondary power source is conveniently electrically mateable to the motor when the primary power source becomes inactive. The motor is operably engaged with the first and second shafts in such a manner that the first and second shafts rotate in sync during operating conditions.

The lifting mechanism may further include a plurality of support brackets equidistantly spaced along the top surface of the first platform and registered along a rectilinear path aligned with the longitudinal axis of the first platform. A plurality of worm gear shafts have opposed end portions conjoined to the support brackets respectively wherein each worm gear shaft has a threaded outer surface oriented along linearly opposing directions. First and second couplings are operably mounted about the worm gear shafts wherein the first coupling is restricted from moving beyond a first linear path and the second coupling is restricted from moving beyond a second linear path.

The lifting mechanism preferably also includes a third coupling mounted to the bottom surface of the second platform and extending downwardly therefrom. First and second scissor arm assemblies are securely conjoined to the couplings respectively and a controller is mounted to one guide rail and electrically coupled to the motor, allowing the operator to conveniently raise and lower the second platform from an elevated height. Such first and second scissor arm assemblies are adapted between extended and compressed positions as the couplings linearly travel along the first and second paths.

The first and second scissor arm assemblies may include first and second pairs of rectilinear arms, each being pivotally connected to the first, second, and third couplings respectively. Each of the first and second pairs of rectilinear arms preferably include a first pair of intersecting beams pivotally connected to the first and second couplings and a second pair of intersecting beams pivotally connected to the first pair of intersecting beams and the third coupling. A plurality of spacers have opposed end portions conjoined to the first and second pairs of rectilinear arms in such a manner that the first and second pairs of rectilinear arms maintain a fixed spatial relationship during operating conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
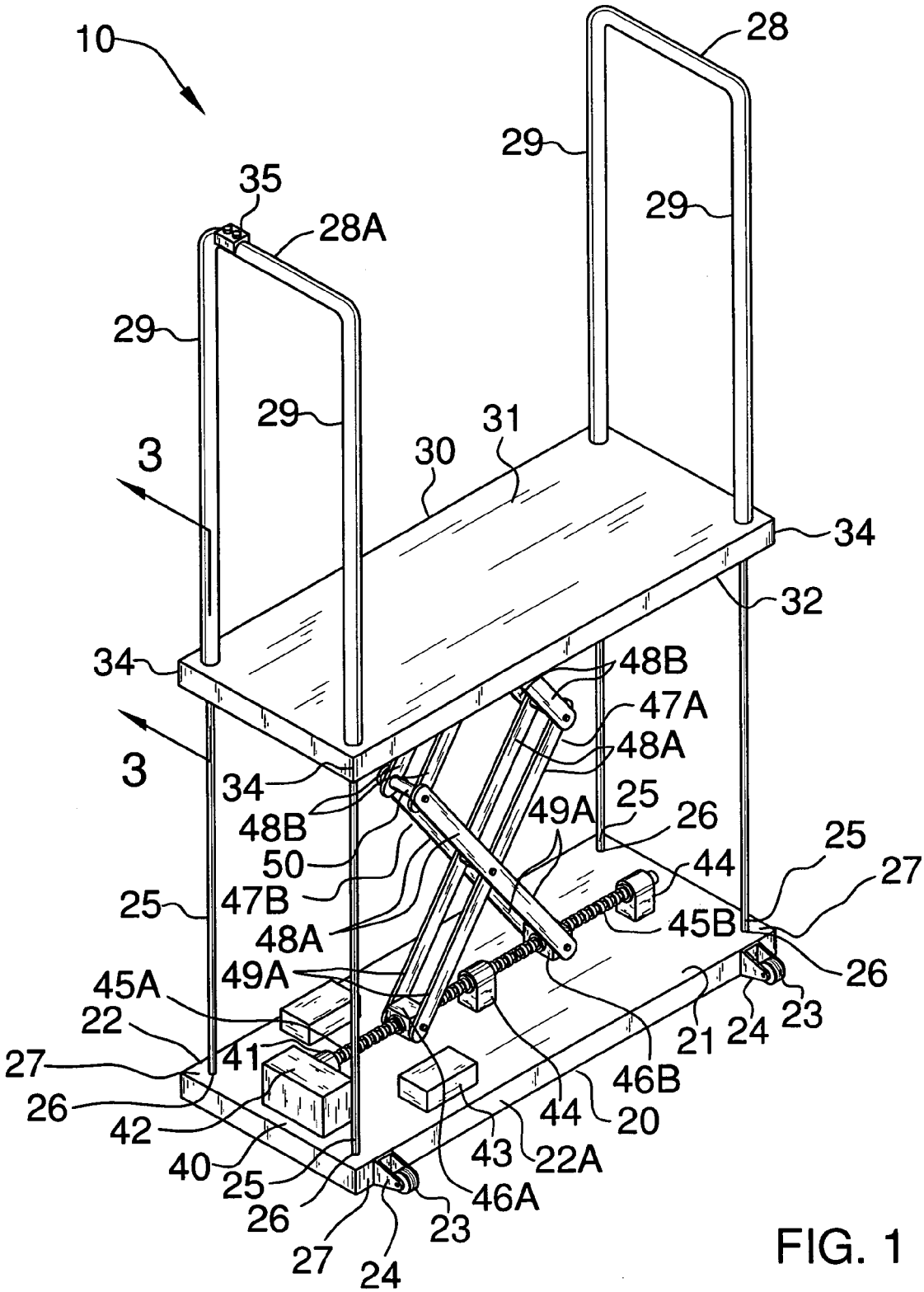
FIG. 1 is a perspective view showing a scissor-lift assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–4 by the reference numeral 10 and is intended to provide a scissor-lift assembly. It should be understood that the assembly 10 may be used to raise persons for many different types of applications and should not be limited in use to only home and small commercial applications.

Referring initially to FIG. 1, the assembly 10 includes a first platform 20 provided with a planar top surface 21 that has a centrally registered longitudinal axis. Such a first platform 20 further has a pair of opposed sides 22 equidistantly spaced from the longitudinal axis and traveling parallel thereto. The first platform 20 includes a plurality of wheels 23 and a plurality of brackets 24 operably connected thereto wherein the wheels 23 and the brackets 24 extend outwardly from one of the sides 22A and has an axis of rotation situated orthogonal thereto.

Such wheels 23 and brackets 24 are spaced at opposed end portions of the platform 20, which is essential for ensuring the assembly 10 remains stable during the transportation thereof. The assembly 10 can be rotated about one side 22A in such a manner that the wheels 23 become operably engaged with a ground surface while the first 20 and second 30 (described herein below) platforms become oriented perpendicular to the ground surface and thereby advantageously allow the operator to quickly and readily transport the assembly 10 between remote locations, saving the user a considerable amount of time and energy.

Referring to FIGS. 1 through 4, a plurality of rectilinear support shafts 25 have opposed end portions 26 securely conjoined to the platform 20 and extending upwardly therefrom along a vertical axis situated orthogonal to the longitudinal axis. Such rectilinear support shafts 25 are equidistantly spaced at opposed corners 27 of the platform 20 and are coextensive. Of course, the rectilinear shafts 25 may be produced to have a variety of different lengths and diameters for various height requirements, as is obvious to a person of ordinary skill in the art.

Figure 2A:
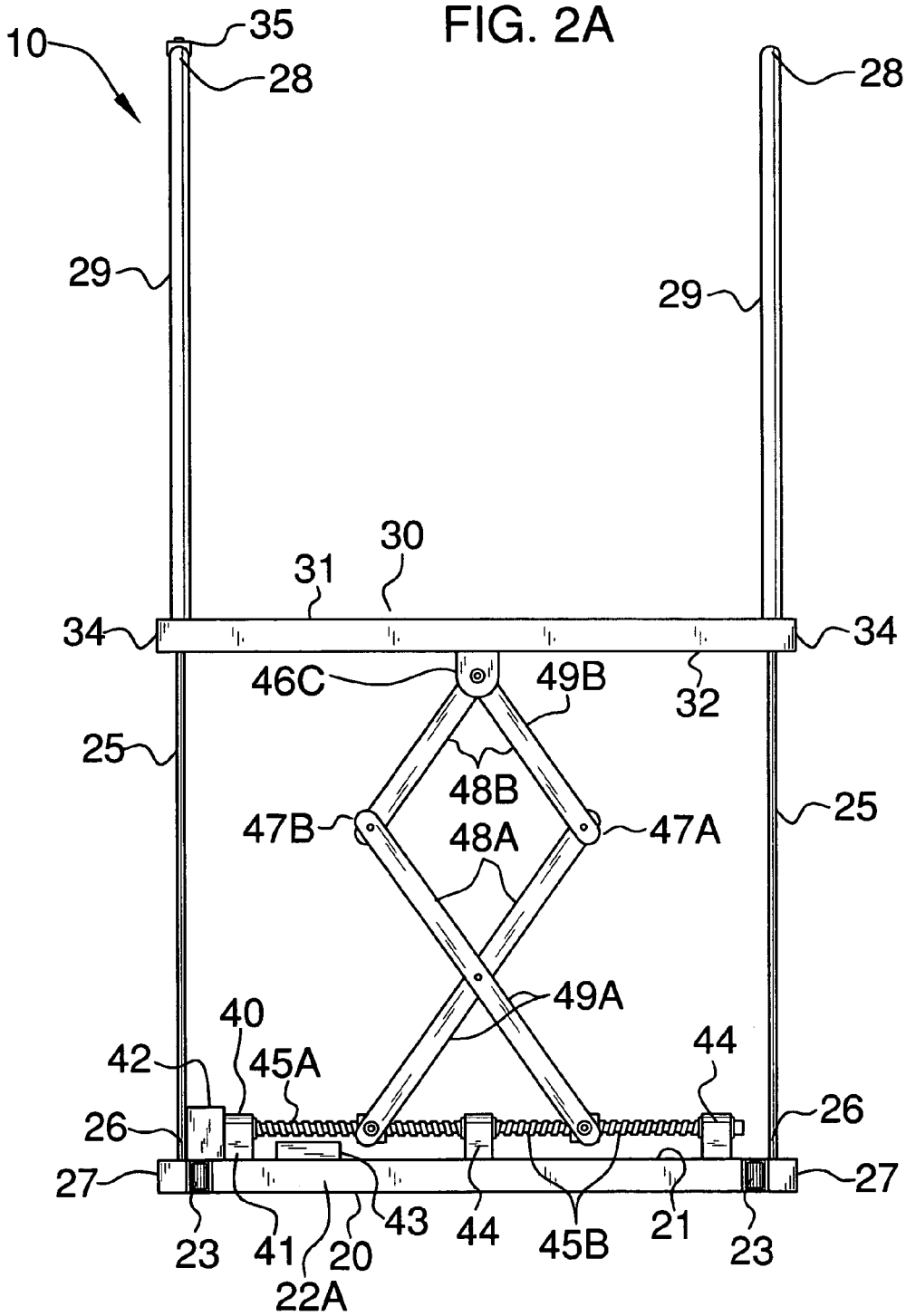
FIG. 2*a* is a front-elevational view of the assembly shown in FIG. 1, showing the second platform at an elevated position.
Figure 2B:
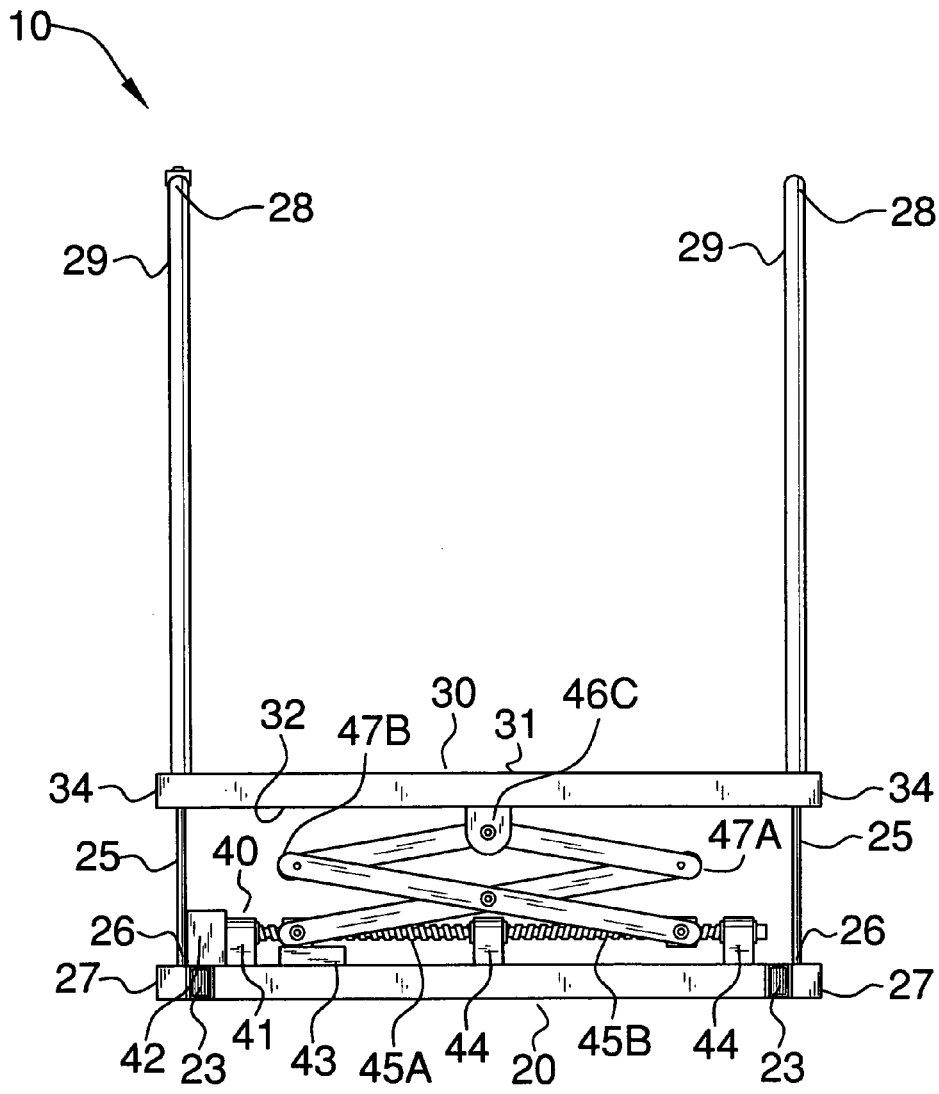
FIG. 2*b* is a front-elevational view of the assembly shown in FIG. 1, showing the second platform at a lowered position.
Figure 3:
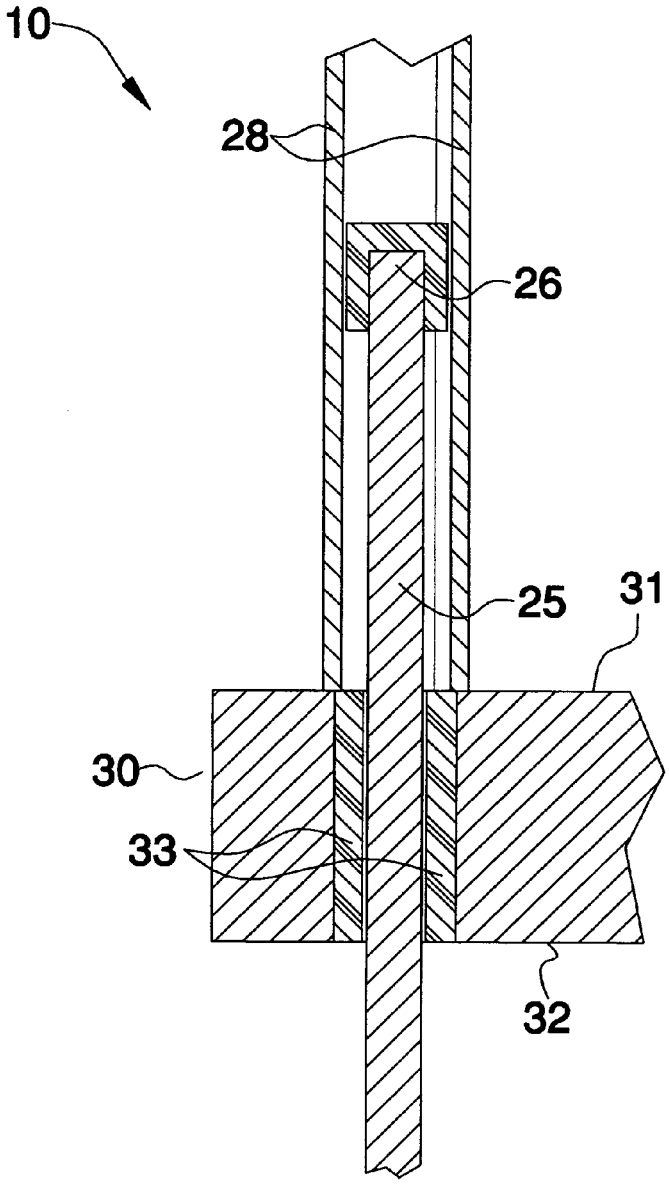
FIG. 3 is a cross-sectional view of the assembly shown in FIG. 1, taken along line 3—3.
Figure 4:
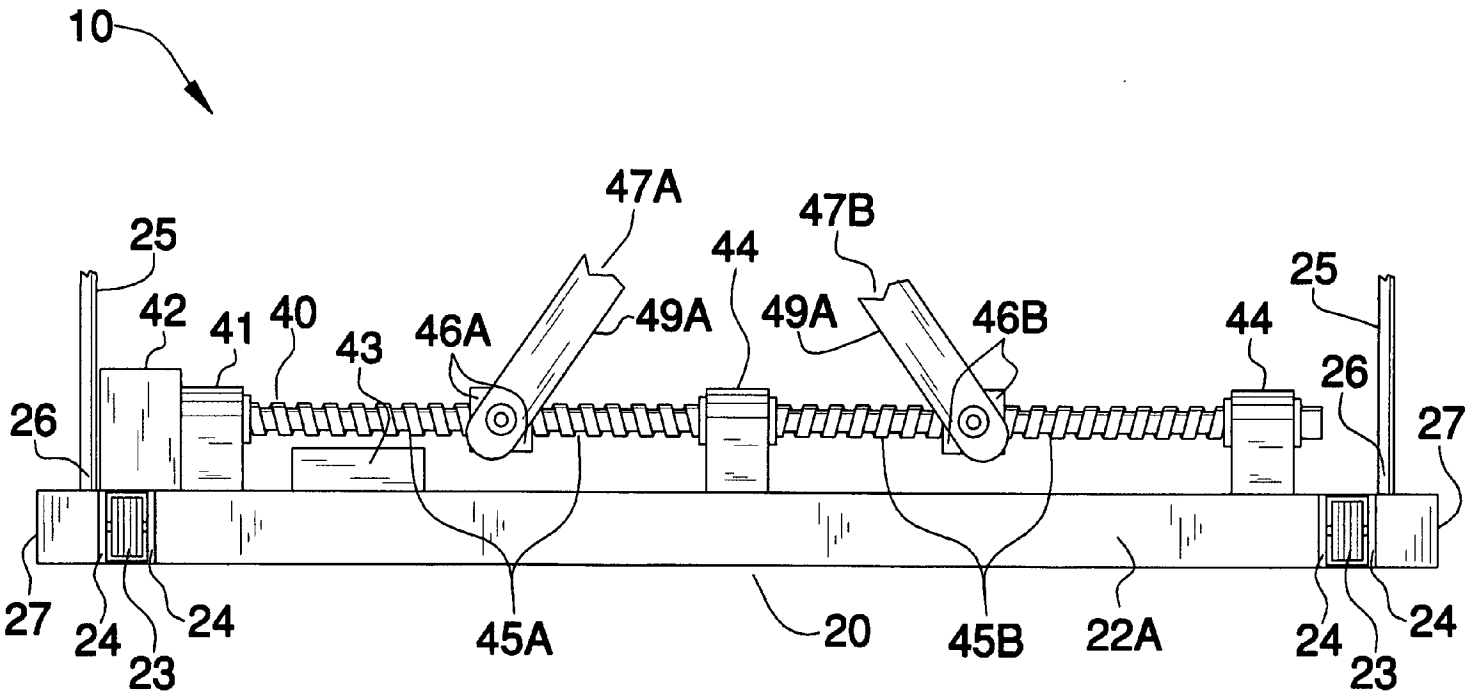
FIG. 4 is an enlarged front-elevational view of the first platform shown in FIG. 2A.

Referring to FIGS. 1 through 3, a pair of inverted U-shape guide rails 28 are telescopically engageable along a longitudinal length of the support shafts 25. Each guide rail 28 has a pair of monolithically formed rectilinear regions 29 slidably positionable about the support shafts 25 such that the guide rails 28 can effectively be raised and lowered along a predetermined vertical path during operating conditions. Such guide rails 28 are also important for providing a convenient surface to grab hold of during operating conditions, so that an operator of the assembly 10 is further stabilized.

Referring to FIGS. 1 through 4, a second platform 30 is provided with planar top 31 and bottom 32 surfaces and has a plurality of apertures 33 formed at opposed corners 34 thereof. Such apertures 33 are vertically registered with the support shafts 25 and effectively receive the support shafts 25 therethrough such that the second platform 30 can conveniently be raised and lowered in sync with the guide rails 25. The second platform 30 is also critical for providing increased surface area where an operator may advantageously place extra tools and materials required for the task at hand, thus eliminating time and energy consuming trips up and down the assembly 10. The first 20 and second 30 platforms are coextensive.

Still referring to FIGS. 1, 2*a*, 2*b* and 4, a lifting mechanism 40 is included for vertically biasing the second platform 30 and the guide rails 28 along a longitudinal length of the support shaft 25. Such a lifting mechanism 40 is securely connected to the top surface 21 of the first platform 20 and the bottom surface 32 of the second platform 30. The lifting mechanism 40 includes a motor 41 securely conjoined to the top surface 21 of the first platform 20, a primary power source 42 situated adjacent to the motor 41 and electrically mated thereto, and a secondary power source 43 situated adjacent to the motor 41. Such a secondary power source 43 is conveniently electrically mateable to the motor 41 when the primary power source 42 becomes inactive. The motor 41 is operably engaged with the first 45A and second 45B shafts (described herein below) in such a manner that the first 45A and second 45B shafts rotate in sync during operating conditions.

Again referring to FIGS. 1, 2*a*, 2*b* and 4, the lifting mechanism 40 further includes a plurality of support brackets 44 equidistantly spaced along the top surface 21 of the first platform 20 and registered along a rectilinear path aligned with the longitudinal axis of the first platform 20. A plurality of worm gear shafts 45 have opposed end portions conjoined to the support brackets 44 respectively wherein each worm gear shaft 45 has a threaded outer surface oriented along linearly opposing directions.

Such a threaded outer surface of the worm gear shafts 45 is critical for allowing the couplings 46A and 46B (described herein below) to be linearly displaced therealong. As a horizontal longitudinal length between the first 46A and second 46B couplings is increased or decreased, a vertical height of the second platform 30 is effectively decreased or increased, respectively. It is also essential that the threads on the outer surface of the worm gear shafts 45A, 45B are oriented in opposite directions, allowing for the couplings 46A, 46B to simultaneously move towards or away from each other, depending on the rotation of the worm gear shafts 45. First 46A and second 46B couplings are operably mounted about the worm gear shafts 45 wherein the first coupling 46A is restricted from moving beyond a first linear path and the second coupling 46B is restricted from moving beyond a second linear path.

Referring to FIGS. 2*a* and 2*b*, the lifting mechanism 40 also includes a third coupling 46C mounted to the bottom surface 32 of the second platform 30 and extending downwardly therefrom. First 47A and second 47B scissor arm assemblies are securely conjoined to the couplings 46 respectively and a controller 35 is mounted to one guide rail 28A and electrically coupled to the motor 41, which is essential for allowing the operator to conveniently raise and lower the second platform 30 from an elevated height. Such first 47A and second 47B scissor arm assemblies are adapted between extended and compressed positions as the couplings 46 linearly travel along the first and second paths.

Referring to FIGS. 1, 2*a*, 2*b* and 4, the first 47A and second 47B scissor arm assemblies include first 48A and second 48B pairs of rectilinear arms each being pivotally connected to the first 46A, second 46B and third 46C couplings respectively. Each of the first 48A and second 48B pairs of rectilinear arms include a first pair of intersecting beams 49A pivotally connected to the first 46A and second 46B couplings and a second pair of intersecting beams 49B pivotally connected to the first pair of intersecting beams 49A and the third coupling 46C. A plurality of spacers 50 have opposed end portions conjoined to the first 48A and second 48B pairs of rectilinear arms, which is critical for allowing the first 48A and second 48B pairs of rectilinear arms to maintain a fixed spatial relationship during operating conditions, thus further ensuring the stability of the assembly 10.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable assembly for lifting an operator along a vertical plane, said assembly comprising:

a first platform provided with a planar top surface and having a centrally registered longitudinal axis, said first platform further having a pair of opposed sides equidistantly spaced from the longitudinal axis and traveling parallel thereto, said first platform including a plurality of wheels and a plurality of brackets operably connected thereto wherein said wheels and said brackets extend outwardly from one said sides and having an axis of rotation situated orthogonal thereto, said wheels and said brackets being spaced at opposed end portions of said platforms;

a plurality of rectilinear support shafts having opposed end portions securely conjoined to said platform and extending upwardly therefrom along a vertical axis situated orthogonal to the longitudinal axis, said rectilinear support shafts being equidistantly spaced at opposed corners of said platform;

a pair of inverted U-shape guide rails telescopically engageable along a longitudinal length of said support shafts, each said guide rails having a pair of monolithically formed rectilinear regions slidably positionable about said support shafts such that said guide rails can be raised and lowered along a predetermined vertical path during operating conditions;

a second platform provided with planar top and bottom surfaces and having a plurality of apertures formed at opposed corners thereof, said apertures being vertically registered with said support shafts and receiving said support shafts therethrough such that said second platform can be raised and lowered in sync with said guide rails; and lifting means for vertically biasing said second platform and said guide rails along a longitudinal length of said support shaft, said lifting means being securely connected to said top surface of said first platform and said bottom surface of said second platform;

wherein said assembly can be rotated about said one side in such a manner that said wheels become operably engaged with a ground surface while said first and second platforms become oriented perpendicular to the ground surface and thereby allowing the operator to quickly and readily transport said assembly between remote locations.

2. The assembly of claim 1, wherein said lifting means comprises:

a motor securely conjoined to said top surface of said first platform;

a primary power source situated adjacent said motor and electrically mated thereto;

a secondary power source situated adjacent said motor, said secondary power source being electrically mateable to said motor when said primary power source becomes inactive;

a plurality of support brackets equidistantly spaced along said top surface of said first platform and registered along a rectilinear path aligned with the longitudinal axis of said first platform;

a plurality of worm gear shafts having opposed end portions conjoined to said support brackets respectively, each said worm gear shaft having a threaded outer surface oriented along linearly opposing directions;

first and second couplings operably mounted about said worm gear shafts wherein said first coupling is restricted from moving beyond a first linear path and said second coupling is restricted from moving beyond a second linear path;

a third coupling mounted to said bottom surface of said second platform and extending downwardly therefrom;

first and second scissor arm assemblies securely conjoined to said first and second couplings respectively; and a controller mounted to one said guide rails and electrically coupled to said motor for allowing the operator to raise and lower said second platform from an elevated height;

wherein said first and second scissor arm assemblies are adapted between extended and compressed positions as said couplings linearly travel along said first and second paths, said motor being operably engaged with said first and second shafts in such a manner that said first and second shafts rotate in sync during operating conditions.

3. The assembly of claim 2, wherein each said first and second scissor arm assemblies comprises:

first and second pairs of rectilinear arms each being pivotally connected to said first and second couplings, respectively, and to said third coupling; and a plurality of spacers having opposed end portions conjoined to said first and second pairs of rectilinear arms in such a manner that said first and second pairs of rectilinear arms maintain a fixed spatial relationship during operating conditions.

4. The assembly of claim 3, wherein each said first and second pairs of rectilinear arms comprise:

a first pair of intersecting beams pivotally connected to said first and second couplings; and a second pair of intersecting beams pivotally connected to said first pair of intersecting beams and said third coupling.

5. A portable assembly for lifting an operator along a vertical plane, said assembly comprising:

a first platform provided with a planar top surface and having a centrally registered longitudinal axis, said first platform further having a pair of opposed sides equidistantly spaced from the longitudinal axis and traveling parallel thereto, said first platform including a plurality of wheels and a plurality of brackets operably connected thereto wherein said wheels and said brackets extend outwardly from one said sides and having an axis of rotation situated orthogonal thereto, said wheels and said brackets being spaced at opposed end portions of said platform;

a plurality of rectilinear support shafts having opposed end portions securely conjoined to said platform and extending upwardly therefrom along a vertical axis situated orthogonal to the longitudinal axis, said rectilinear support shafts being equidistantly spaced at opposed corners of said platform;

a pair of inverted U-shape guide rails telescopically engageable along a longitudinal length of said support shafts, each said guide rails having a pair of monolithically formed rectilinear regions slidably positionable about said support shafts such that said guide rails can be raised and lowered along a predetermined vertical path during operating conditions;

a second platform provided with planar top and bottom surfaces and having a plurality of apertures formed at opposed corners thereof, said apertures being vertically registered with said support shafts and receiving said support shafts therethrough such that said second platform can be raised and lowered in sync with said guide rails, said first and second platforms being coextensive; and lifting means for vertically biasing said second platform and said guide rails along a longitudinal length of said support shaft, said lifting means being securely connected to said top surface of said first platform and said bottom surface of said second platform;

wherein said assembly can be rotated about said one side in such a manner that said wheels become operably engaged with a ground surface while said first and second platforms become oriented perpendicularly to the ground surface and thereby allowing the operator to quickly and readily transport said assembly between remote locations.

6. The assembly of claim 5, wherein said lifting means comprises:

a motor securely conjoined to said top surface of said first platform;

a primary power source situated adjacent said motor and electrically mated thereto;

a secondary power source situated adjacent said motor, said secondary power source being electrically mateable to said motor when said primary power source becomes inactive;

a plurality of support brackets equidistantly spaced along said top surface of said first platform and registered along a rectilinear path aligned with the longitudinal axis of said first platform;

a plurality of worm gear shafts having opposed end portions conjoined to said support brackets respectively, each said worm gear shafts having a threaded outer surface oriented along linearly opposing directions;

first and second couplings operably mounted about said worm gear shafts wherein said first coupling is restricted from moving beyond a first linear path and said second coupling is restricted from moving beyond a second linear path;

a third coupling mounted to said bottom surface of said second platform and extending downwardly therefrom;

first and second scissor arm assemblies securely conjoined to said couplings respectively; and a controller mounted to one said guide rails and electrically coupled to said motor for allowing the operator to raise and lower said second platform from an elevated height;

wherein said first and second scissor arm assemblies are adapted between extended and compressed positions as said couplings linearly travel along said first and second paths, said motor being operably engaged with said first and second shafts in such a manner that said first and second shafts rotate in sync during operating conditions.

7. The assembly of claim 6, wherein each said first and second scissor arm assemblies comprises:

first and second pairs of rectilinear arms each being pivotally connected to said first, second and third couplings respectively; and a plurality of spacers having opposed end portions conjoined to said first and second pairs of rectilinear arms in such a manner that said first and second pairs of rectilinear arms maintain a fixed spatial relationship during operating conditions.

8. The assembly of claim 7, wherein each said first and second pairs of rectilinear arms comprise:

a first pair of intersecting beams pivotally connected to said first and second couplings; and a second pair of intersecting beams pivotally connected to said first pair of intersecting beams and said third coupling.

9. A portable assembly for lifting an operator along a vertical plane, said assembly comprising:

a first platform provided with a planar top surface and having a centrally registered longitudinal axis, said first platform further having a pair of opposed sides equidistantly spaced from the longitudinal axis and traveling parallel thereto, said first platform including a plurality of wheels and a plurality of brackets operably connected thereto wherein said wheels and said brackets extend outwardly from one said sides and having an axis of rotation situated orthogonal thereto, said wheels and said brackets being spaced at opposed end portions of said platform;

a plurality of rectilinear support shafts having opposed end portions securely conjoined to said platform and extending upwardly therefrom along a vertical axis situated orthogonal to the longitudinal axis, said rectilinear support shafts being equidistantly spaced at opposed corners of said platform, said support shafts being coextensive;

a pair of inverted U-shape guide rails telescopically engageable along a longitudinal length of said support shafts, each said guide rails having a pair of monolithically formed rectilinear regions slidably positionable about said support shafts such that said guide rails can be raised and lowered along a predetermined vertical path during operating conditions;

a second platform provided with planar top and bottom surfaces and having a plurality of apertures formed at opposed corners thereof, said apertures being vertically registered with said support shafts and receiving said support shafts therethrough such that said second platform can be raised and lowered in sync with said guide rails, said first and second platforms being coextensive; and lifting means for vertically biasing said second platform and said guide rails along a longitudinal length of said support shaft, said lifting means being securely connected to said top surface of said first platform and said bottom surface of said second platform;

wherein said assembly can be rotated about said one side in such a manner that said wheels become operable engaged with a ground surface while said first and second platforms become oriented perpendicular to the ground surface and thereby allowing the operator to quickly and readily transport said assembly between remote locations.

10. The assembly of claim 9, wherein said lifting means comprises:

a motor securely conjoined to said top surface of said first platform;

a primary power source situated adjacent said motor and electrically mated thereto;

a secondary power source situated adjacent said motor, said secondary power source being electrically mateable to said motor when said primary power source becomes inactive;

a plurality of support brackets equidistantly spaced along said top surface of said first platform and registered along a rectilinear path aligned with the longitudinal axis of said first platform;

a plurality of worm gear shafts having opposed end portions conjoined to said support brackets respectively, each said worm gear shafts having a threaded outer surface oriented along linearly opposing directions;

first and second couplings operably mounted about said worm gear shafts wherein said first coupling is restricted from moving beyond a first linear path and said second coupling is restricted from moving beyond a second linear path;

a third coupling mounted to said bottom surface of said second platform and extending downwardly therefrom;

first and second scissor arm assemblies securely conjoined to said first and second couplings respectively; and a controller mounted to one said guide rails and electrically coupled to said motor for allowing the operator to raise and lower said second platform from an elevated height;

wherein said first and second scissor arm assemblies are adapted between extended and compressed positions as said couplings linearly travel along said first and second paths, said motor being operably engaged with said first and second shafts in such a manner that said first and second shafts rotate in sync during operating conditions.

11. The assembly of claim 10, wherein each said first and second scissor arm assemblies comprises:

first and second pairs of rectilinear arms each being pivotally connected to said first and second couplings, respectively, and to said third coupling; and a plurality of spacers having opposed end portions conjoined to said first and second pairs of rectilinear arms in such a manner that said first and second pairs of rectilinear arms maintain a fixed spatial relationship during operating conditions.

12. The assembly of claim 11, wherein each said first and second pairs of rectilinear arms comprise:

a first pair of intersecting beams pivotally connected to said first and second couplings; and a second pair of intersecting beams pivotally connected to said first pair of intersecting beams and said third coupling.

* * * * *